US007431421B2

(12) United States Patent
Carcia et al.

(10) Patent No.: US 7,431,421 B2
(45) Date of Patent: Oct. 7, 2008

(54) PRINTING SYSTEM AND METHOD

(75) Inventors: Anthony P. Carcia, Portland, OR (US); Alan Shibata, Camas, WA (US); Rick M. Tanaka, Vancouver, WA (US); Justin M. Roman, Portland, OR (US); Tanya Schneider, Vancouver, WA (US); Charles W. Singleton, Jr., Camas, WA (US); Shayler M. Backlund, North Logan, UT (US); Ernesto A. Garay, Camas, WA (US); Angela Chen Krauskopf, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 392 days.

(21) Appl. No.: 11/114,459

(22) Filed: Apr. 26, 2005

(65) Prior Publication Data

US 2006/0238561 A1 Oct. 26, 2006

(51) Int. Cl.
*B41J 2/165* (2006.01)
*B41J 2/01* (2006.01)

(52) U.S. Cl. ..... 347/25; 347/102; 347/34

(58) Field of Classification Search ..... 347/34, 347/83, 102, 20, 38, 39, 43, 25
See application file for complete search history.

(56) References Cited

U.S. PATENT DOCUMENTS

| | | | | |
|---|---|---|---|---|
| 3,983,801 | A | 10/1976 | Watanabe et al. | |
| 4,369,450 | A | 1/1983 | Iwagami et al. | |
| 4,591,869 | A | 5/1986 | Katerberg et al. | |
| 5,774,141 | A | 6/1998 | Cooper et al. | |
| 5,871,292 | A | 2/1999 | Johnson et al. | |
| 5,966,145 | A | 10/1999 | Miura et al. | |
| 6,203,152 | B1 | 3/2001 | Boleda et al. | |
| 6,220,693 | B1 * | 4/2001 | Bode et al. | 347/34 |
| 6,280,014 | B1 | 8/2001 | Sharma et al. | |
| 6,461,064 | B1 | 10/2002 | Leonard et al. | |
| 6,464,328 | B1 * | 10/2002 | Hiramatsu et al. | 347/34 |
| 6,491,364 | B2 | 12/2002 | Pietrzyk et al. | |
| 6,592,213 | B2 | 7/2003 | Long | |
| 6,643,220 | B2 | 11/2003 | Anderson et al. | |
| 6,663,215 | B2 | 12/2003 | Klausbruckner et al. | |
| 6,719,398 | B1 | 4/2004 | McElfresh et al. | |
| 6,820,970 | B2 | 11/2004 | Long | |

* cited by examiner

*Primary Examiner*—Shih-Wen Hsieh

(57) ABSTRACT

Various embodiments of a printing system including a vacuum duct are disclosed.

30 Claims, 7 Drawing Sheets

PRINTING SYSTEM AND METHOD

BACKGROUND

During the deposition of ink during printing, aerosol is sometimes formed. The aerosol may collect on a print medium and affect print quality. The aerosol may also accumulate on and affect performance of the components of a printing system.

DETAILED DESCRIPTION OF THE EXAMPLE EMBODIMENTS

Figure 1:
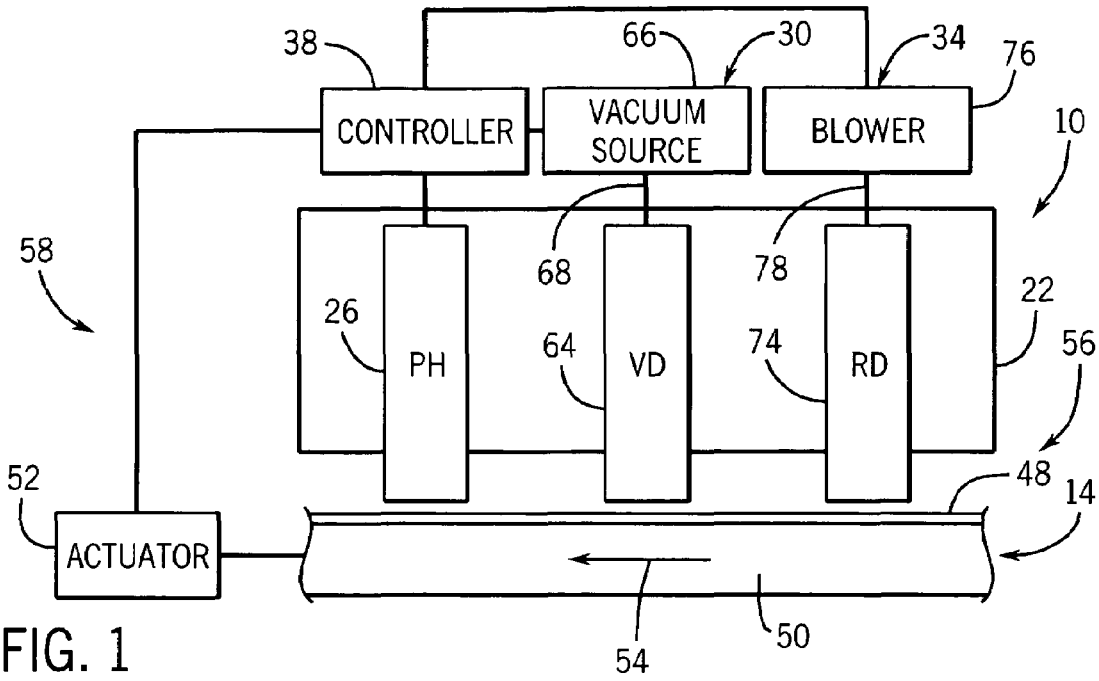
FIG. 1 is a schematic illustration of a printing system according to one example embodiment.

FIG. 1 schematically illustrates printing system 10 which generally includes media transport 14, support 22, printhead 26, aerosol removal system 30, air replenishment system 34 and controller 38. Media transport 14 comprises a mechanism configured to move a medium to be printed upon, such as medium 48 shown, relative to printhead 26. Media transport 14 includes a media support 50 and actuator 52. Media support 50 comprises one or more structures upon which medium 48 is supported as it is moved relative to printhead 26. In one embodiment, support 50 may comprise one or more belts extending opposite printhead 26. In another embodiment, media support 50 may comprise one or more rollers which either extend opposite to printhead 26 or which support and suspend medium 48 opposite to printheads 26. In still another embodiment, media support 50 may comprise a structure such as a platform which is shuttled or moved relative to printhead 26. In still other embodiments, media support 50 may comprise a cylinder or drum supporting medium 48 which is rotated relative to printhead 26.

Actuator 52 generally comprises a mechanism configured to move media support 50 relative to printhead 26. In one embodiment where media support 50 comprises a generally flat supporting surface such as a shuttle tray, actuator 52 may comprise a linear actuator. In other embodiments in which media support 50 comprises one or more rollers, one or more belts, or a drum, actuator 52 may comprise a rotary actuator configured to rotate the rollers, the roller supporting the one or more belts or the drum.

Support 22 generally comprises a mount, frame or other structure configured to support printhead 26 and at least portions of aerosol removal system 30 and air replenishment system 34 relative to media support 50. In one embodiment, support 22 may comprise a carriage configured to be moved relative to media support 50. In another embodiment, media support 22 may be stationary with respect to media support 50.

Printhead 26 comprises a mechanism configured to interact with medium 48 so as to form an image upon medium 48. In the particular embodiment shown, printhead 26 comprises a mechanism configured to dispense fluid or imaging material, such as ink, upon medium 48. In one embodiment, printhead 26 comprises a thermal inkjet printhead. In other embodiment, printhead 26 comprises a piezo electric printhead. In the example shown, printhead 26 is supported in relative close proximity to media support 50 to enhance print quality.

Aerosol removal system 30 comprises a system configured to remove aerosol that may be formed during the dispensing of imaging material upon medium 48 by printhead 26. System 30 includes vacuum duct 64 and vacuum source 66. Vacuum duct 64 comprises a duct, plenum, portal, tube, channel or other structure forming a passage through which vacuum may be applied to remove aerosol. Vacuum duct 64 is supported by support 22 in close proximity with printhead 26. In other embodiments, vacuum duct 64 may be supported proximate to printhead 26 by other structures other than support 22. Vacuum duct 64 is pneumatically connected to vacuum source 66 by one or more intermediate pneumatic conduits 68 which may comprise tubes, hoses or other structures forming pneumatic passageways.

Vacuum source 66 comprises a mechanism configured to create a vacuum within vacuum duct 64 so as to withdraw aerosol from proximate medium 48. In one embodiment, vacuum source 66 comprises a blower configured to create a low pressure region within vacuum duct 64. In another embodiment, vacuum source 66 includes filters or other mechanisms for handling aerosol that is withdrawn through vacuum duct 64.

Air replenishment system 34 comprises a system configured to at least partially replenish or replace air removed by vacuum duct 64 of aerosol removal system 30. Air replenishment system 34 generally includes replenishment duct 74 and blower 76. Replenishment duct 74 comprises a duct, plenum, portal, tube, hose or other structure forming a gap or passage through which air may be supplied to media support 50 to at least partially replenish air withdrawn by aerosol removal system 30. Replenishment duct 74 is supported by support 22 opposite to media support 50 in relative close proximity to vacuum duct 64. In other embodiments, replenishment duct may be supported relative to media support 50 by other support structures. Replenishment duct 74 is pneumatically connected to blower 76 by conduit 78 which may comprise hose, tubing or other structures providing an air flow passage between blower 76 and duct 74.

Blower 76 comprises a mechanism configured to supply air or other gas actively under pressure to a surface of media support 50 through replenishment duct 74. Blower 76 is configured to supply air through replenishment duct 74 at a sufficient rate and volume so as to laminarize or create a flow pattern of air between support 50 and around and opposite to printhead 26 that is generally in the direction of movement of media support 50 as indicated by arrow 54. As a result, the amount of air flow transverse to direction indicated by arrow 54 which may deflect or alter the flow of imaging material from printhead 26 to medium 48 is reduced.

Controller 38 generally comprises a processing unit in communication with actuator 52, printhead 26, aerosol removal system 30 and air replenishment system 34. For purposes of disclosure, the term "processing unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hardwired circuitry may be used in place of or in combination with software instructions to implement the functions described. Controller 38 is not limited to any specific combination of hardware circuitry and software, nor to any particular source for the instructions executed by the processing unit.

Controller 38 receives data or information from various sensors (not shown) and generates control signals for controlling and adjusting the operation of actuator 52, printhead 26, aerosol removal system 30 and air replenishment system 34. For example, in one embodiment, controller 38 may be configured to sense the amount of imaging material, such as ink, being deposited or ejected by printhead 26 and to adjust the operation of aerosol removal system 30 and air replenishment system 34 based upon such information. In particular, controller 38 may generate control signals increasing the vacuum applied through vacuum duct 64 while also increasing the volume of air supplied through replenishment duct 74. Likewise, in other circumstances, controller 38 may generate control signals reducing the vacuum applied through vacuum duct 64 and reducing the volume of air supplied through replenishment duct 74. Controller 38 may further generate control signals further adjusting the volume of air supplied through replenishment duct 74 based in part upon the sensed or detected speed at which media 48 is being moved by media transport 14 which at sufficiently high speeds may also create turbulence opposite printhead 26 that may deflect imaging material and lessen print quality.

In particular embodiments, air replenishment system 34 may omit blower 76. In such an embodiment, air may be drawn into and supplied through replenishment duct 74 through induction caused by the vacuum along media 48 and media support 50. Because air is replenished through duct 74 rather than transversely from sides of media support 50, undesirable deflection of imaging material ejected from printhead 26 is reduced.

Figure 2:
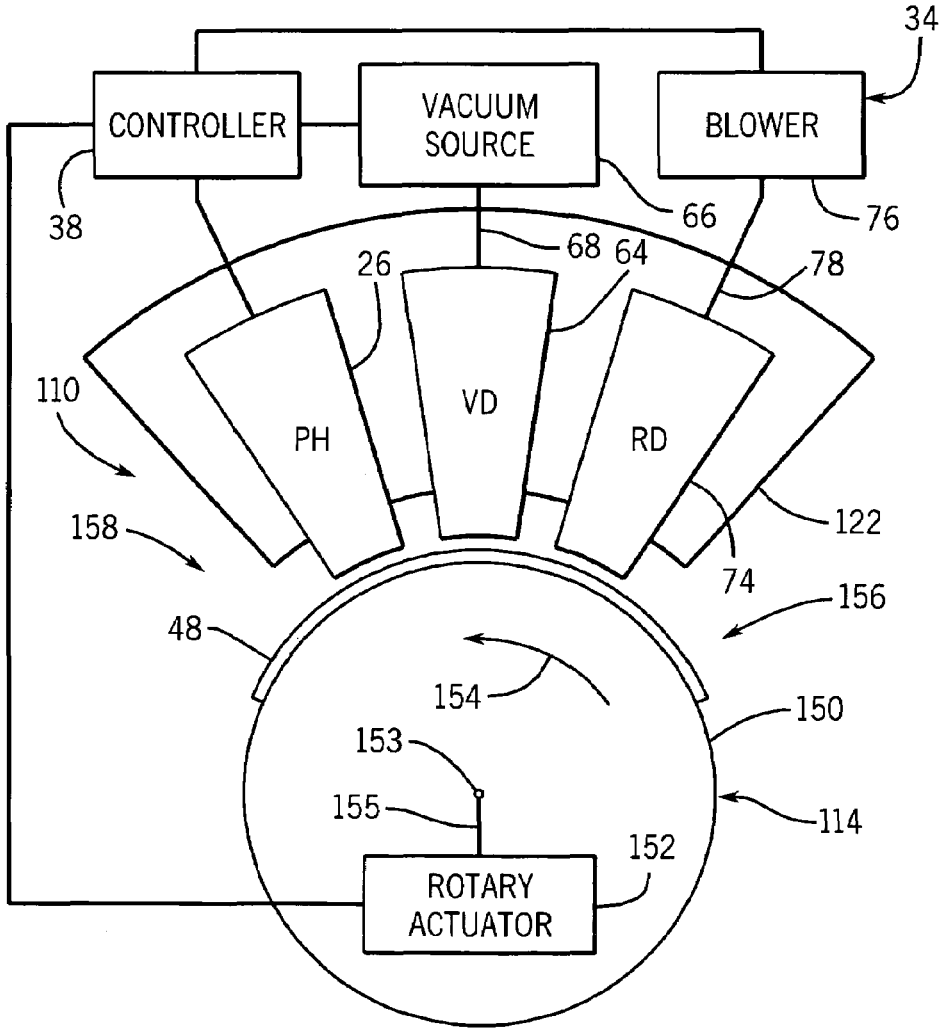
FIG. 2 is a schematic illustration of another embodiment of the printing system of FIG. 1 according to one example embodiment.

FIG. 2 schematically illustrates printing system 110, another embodiment of system 10. System 110 is similar to system 10 except that system 110 includes media transport 1 14 in lieu of transport 14 and includes support 122 in lieu of support 22. Those remaining elements of system 110 which correspond to components of system 10 are numbered similarly.

Media transport 114 is configured to move a medium 48 in an arc relative to printhead 26. In the particular example shown, media transport 114 includes drum 150 and rotary actuator 152. Drum 150 generally comprises an elongate cylinder configured to be rotatably driven about axis 153 in the direction indicated by arrow 154 such that drum 150 has an upstream side 156 with respect to printhead 26 and a downstream side 158 with respect to printhead 26. Rotary actuator 152 comprises a source of torque, such as a motor, operably coupled to drum 150 by a transmission 155 (schematically shown) which may comprise a series of gears, a chain and sprocket arrangement, a belt and pulley arrangement and the like.

Support 122 comprises a frame, body, carriage, housing or other structure configured to support printhead 26, vacuum duct 64 and replenishment duct 74 in an arcuate arrangement with respect to drum 150 and medium 48 carried by drum 150. Because media transport 114 includes drum 150 and rotates a carried medium 48 about axis 153, transport 114 may move medium 48 about axis 153 through multiple passes with respect to printhead 26 while drum 150 is rotated in a single direction 154. As a result, printing speed may be enhanced. Because support 122 supports printhead 26, vacuum duct 64 and replenishment duct 74 in an arcuate arrangement with respect to drum 150, a greater area of medium 48 may be interacted upon by printhead 26, vacuum duct 64 and replenishment duct 74 to further enhance the printing speed. At the same time, vacuum duct 64 removes aerosols produced by printhead 26 and replenishment duct 74 at least partially replenishes or replaces air withdrawn through vacuum duct 64 to reduce transverse air flow that may undesirably deflect imaging material, such as ink, from printhead 26.

Figure 3:
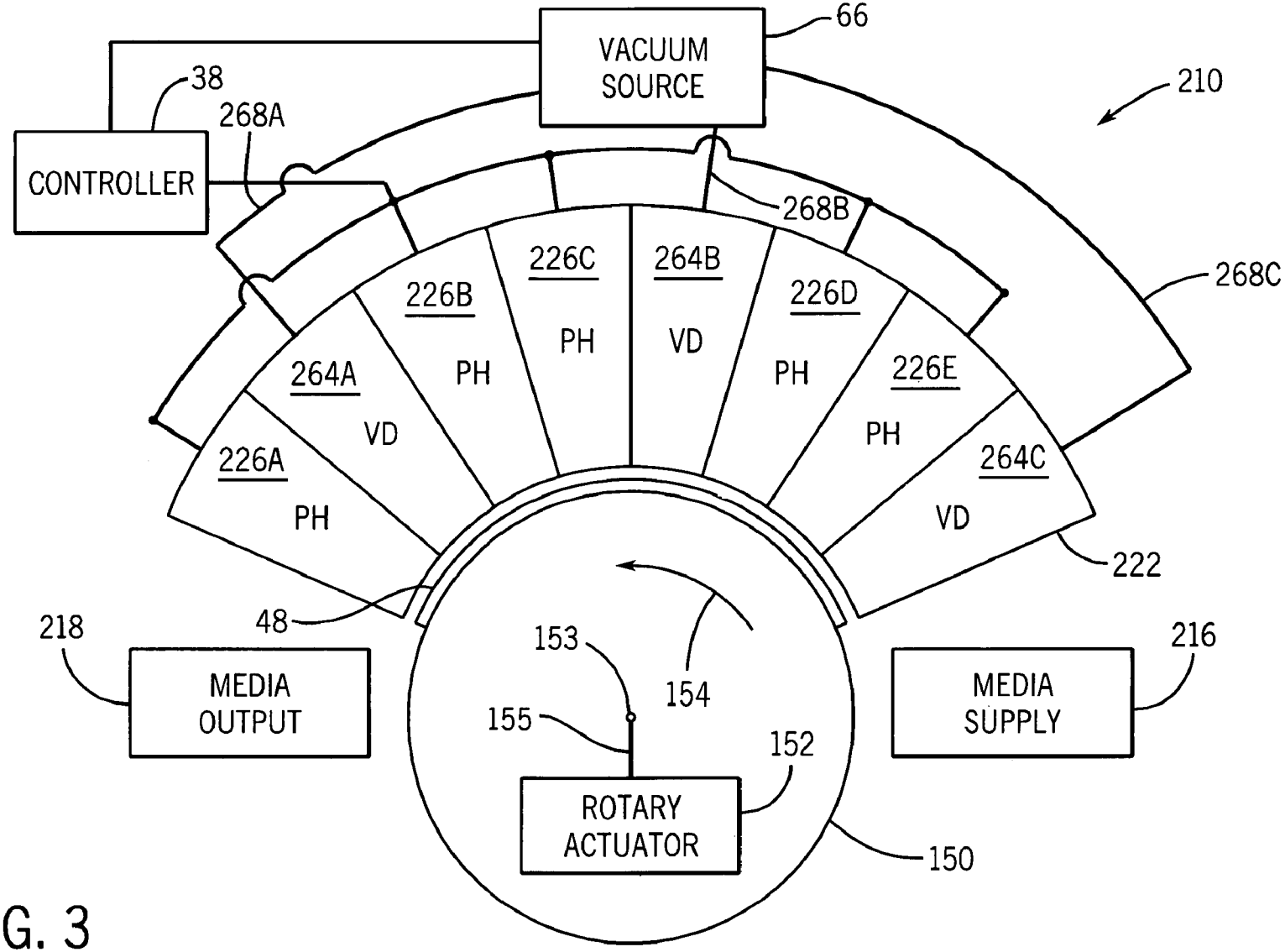
FIG. 3 is a schematic illustration of another embodiment of the printing system of FIG. 1 according to one example embodiment.

FIG. 3 schematically illustrates printing system 210, another embodiment of printing system 10 shown in FIG. 1. Printing system 210 is similar to printing system 110 except that printing system 210 omits air replenishment system 34, includes printheads 226A, 226B, 226C, 226D, 226E (collectively referred to as printheads 226) in lieu of printhead 26 and includes vacuum ducts 264A, 264B and 264C (collectively referred to as vacuum ducts 264) in lieu of vacuum duct 64. FIG. 3 further illustrates media supply 216 and media output 218. Media supply 216, schematically shown, comprises a mechanism configured to supply media to drum 150. In one embodiment, media supply 216 comprises a mechanism configured to pick an individual sheet of media from a stack of media and to supply the individual sheet to drum 150 such that the sheet is wrapped at least partially about drum 150. Media output 218, schematically shown, comprises a mechanism configured to withdraw printed upon media from drum 150 and to transport the withdrawn media to and contain withdrawn media within an output tray, bin and the like.

Support 222 comprises a frame, carriage, housing, body, enclosure, bracket or other structure configured to support printheads 226 and vacuum ducts 264 proximate to drum 150 in an arcuate arrangement. In one embodiment, support 222 may be configured to be moved parallel axis 153. In another embodiment, support 222 may be generally stationary relative to drum 150.

Printheads 226 are substantially similar to printhead 26 in that printheads 226 are configured to deposit a fluid or imaging material, such as a fixer or ink, upon medium 48 supported by drum 150. In the particular example shown, printhead 226A is configured to deposit an ink fixer material upon surface 48. Printhead 226B is configured to deposit a black imaging material and a yellow-colored imaging material upon medium 48. Printhead 226C is configured to deposit a cyan colored imaging material and a magenta colored imaging material upon medium 48. Printhead 226D is similar to printhead 226B and is configured to deposit black and yellow colored imaging material upon medium 48. Printhead 226E, like printhead 226C, is configured to deposit cyan and magenta colored imaging material upon medium 48. In other embodiments, each of printheads 226 may be configured to deposit other imaging materials as well as other colors of imaging material upon medium 48. In other embodiments, imaging system 210 may alternatively include a greater or fewer number of such printheads 226.

Vacuum ducts 264 are similar to vacuum duct 64 in system 110. Vacuum ducts 264A, 264B and 264C are pneumatically connected to vacuum source 66 by pneumatic conduits 268A, 268B and 268C, respectively. As shown by FIG. 3, support 222 supports vacuum ducts 264A, 264B and 264C in an arcuate arrangement about drum 150. Vacuum duct 264A is supported between printheads 226A and 226B. Vacuum duct 264B is supported between printhead 226C and 226D. Vacuum duct 264C is positioned proximate to printhead 226E. As a result, each of printheads 226 are supported proximate to at least one of vacuum ducts 264 for the removal of aerosol produced during dispensing of imaging material by printheads 226.

In the particular pattern or series of printheads and vacuum ducts shown in FIG. 3, five printheads are serviced by three vacuum ducts, providing service to the printheads with fewer vacuum ducts and enabling support 222, printheads 226 and vacuum ducts 264 to be arranged in a more compact fashion and to be manufactured and assembled at a lower cost. Because printing system 210 includes multiple printheads 226 arranged in an arcuate fashion about drum 150, a greater area of medium 48 may be printed upon at any one time, facilitating faster printing. At the same time, print quality may be enhanced because aerosol produced by each of printheads 226 is evacuated via vacuum ducts 264.

Figure 4:
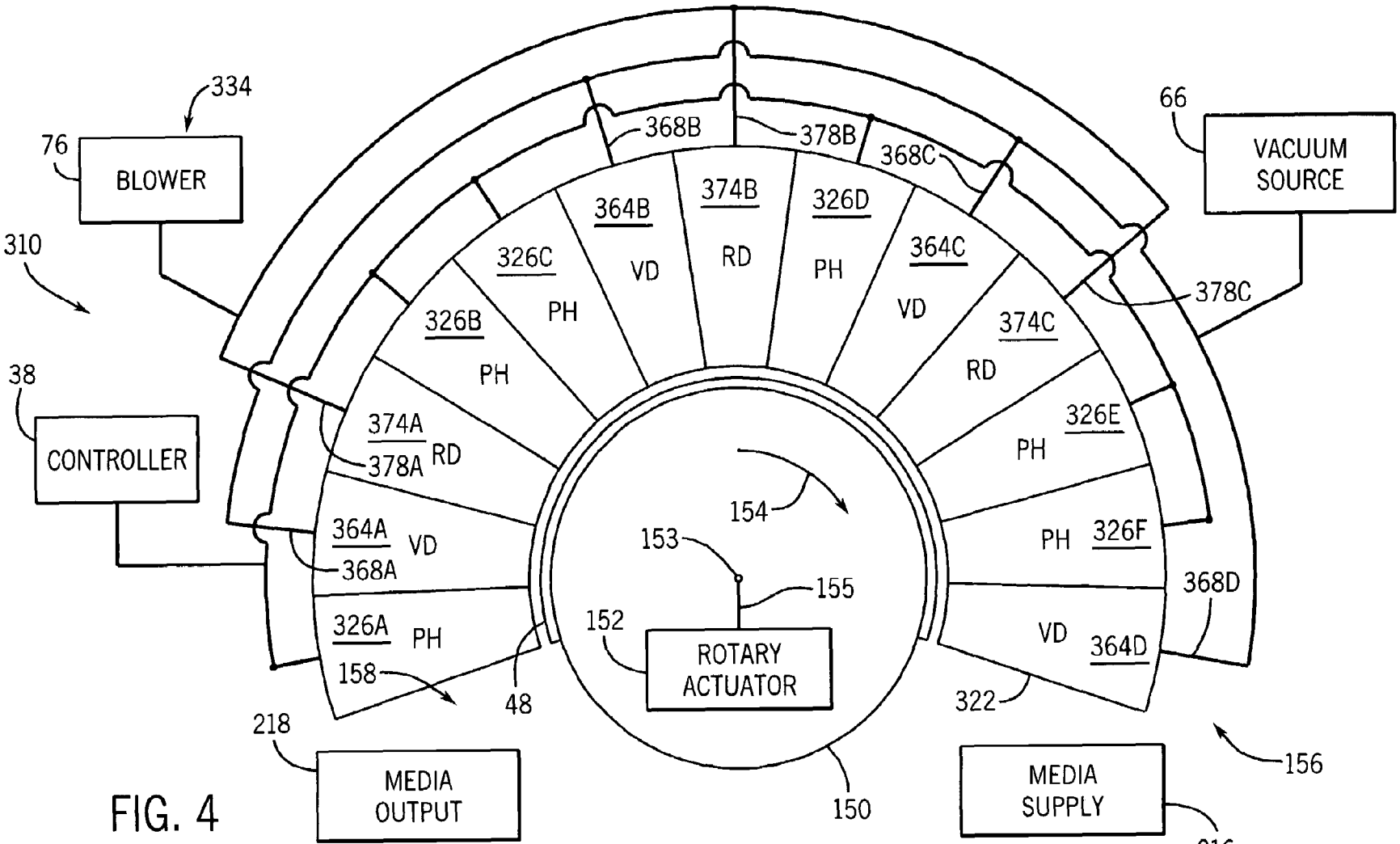
FIG. 4 is a schematic illustration of another embodiment of the printing system of FIG. 1 according to one example embodiment.

FIG. 4 schematically illustrates printing system 310, another embodiment of printing system 10 shown in FIG. 1. Printing system 310 is similar to printing system 210 in FIG. 3 except that printing system 310 includes support 322 in lieu of support 222 and additionally includes air replenishment system 334 which generally includes replenishment ducts 374A, 374B and 374C which are pneumatically coupled to blower 76 by air supply conduits 378A, 378B and 378C, respectively. Support 322 is similar to support 222 except that support 322 additionally supports replenishment ducts 374A and 374B in an arcuate arrangement with respect to drum 150. In one embodiment, support 322 may be configured to be moved along axis 153. In another embodiment, support 322 may be stationary with respect to axis 153 or drum 150.

Replenishment ducts 374A, 374B and 374C are similar to replenishment duct 74 of system 110 (shown and described with respect to FIG. 2) in that replenishment ducts 374A, 374B and 374C are configured to direct and supply air to proximate a surface of drum 150 to at least partially replenish air removed by vacuum ducts 364. As shown by FIG. 4, support 322 supports replenishment duct 374A between vacuum 364A and printhead 326B. As a result, replenishment duct 374A is configured to replace air withdrawn by vacuum duct 364A. Support 322 supports replenishment duct 374B between vacuum duct 364B and printhead 326D. As a result, replenishment duct 374B supplies air to replace air withdrawn by vacuum duct 364B. Support 322 supports replenishment duct 374C between vacuum duct 364C and printhead 326E. As a result, replenishment duct 374C supplies air to replace air withdrawn by vacuum duct 364C. In the particular example shown, each replenishment duct 374 is supported on an upstream side 156 with respect to the corresponding vacuum duct for which it replenishes withdrawn air.

Printheads 326A, 326B, 326C, 326D, 326E and 326F (collectively referred to as printheads 326) are similar to printheads 226 in that printheads 326 are configured to deposit fluid or imaging material upon medium 48 supported by drum 150. Like printheads 226, printheads 326 are supported by support 322 in an arcuate arrangement about drum 150. In the example shown, printhead 326A is configured to deposit an ink fixer material upon medium 48. Printhead 326B is configured to deposit black and yellow imaging material upon medium 48. Printhead 326C is configured to deposit cyan and magenta colored imaging materials upon medium 48. Printheads 326D, 326E and 326F correspond to printheads 326A, 326B and 326C, respectively. In particular, printhead 326D is configured to deposit fixer material upon medium 48. Printhead 326A is configured to selectively deposit black and yellow imaging material or ink upon medium 48. Printhead 326F is configured to selectively deposit cyan and magenta imaging material or ink upon medium 48. In other embodiments, the printheads 326 can be configured to deposit imaging materials of different colors than that of the example materials identified above.

Vacuum ducts 364A, 364B, 364C and 364D (collectively referred to as vacuum ducts 364) are similar to vacuum ducts 264 in that vacuum ducts 364 are configured to withdraw or evacuate aerosol produced by printheads 326 away from medium 48 and drum 150. Vacuum ducts 364 are pneumatically connected to vacuum source 66 by pneumatic conduits 368A, 368B, 368C and 368D, respectively. In the particular example shown, support 322 supports vacuum duct 364A between printhead 326A and replenishment duct 374A. As a result, vacuum duct 364A withdraws aerosol produced by printhead 326A. Support 322 supports vacuum duct 364B between printhead 326C and replenishment duct 374B. As a result, vacuum duct 364B removes aerosol produced by printheads 326B and 326C. Support 322 supports vacuum duct 364C between and in relative close proximity to printheads 326D and replenishment duct 374C. As a result, vacuum 364C removes aerosol produced by printhead 326D. Support 322 supports vacuum duct 364D proximate to printhead 326F. As a result, vacuum duct 364D removes aerosol produced by printheads 326E and 326F. In other embodiments, system 310 may include a greater or fewer number of such vacuum ducts 364 and vacuum ducts 364 may be supported in other relationships.

Figure 5:
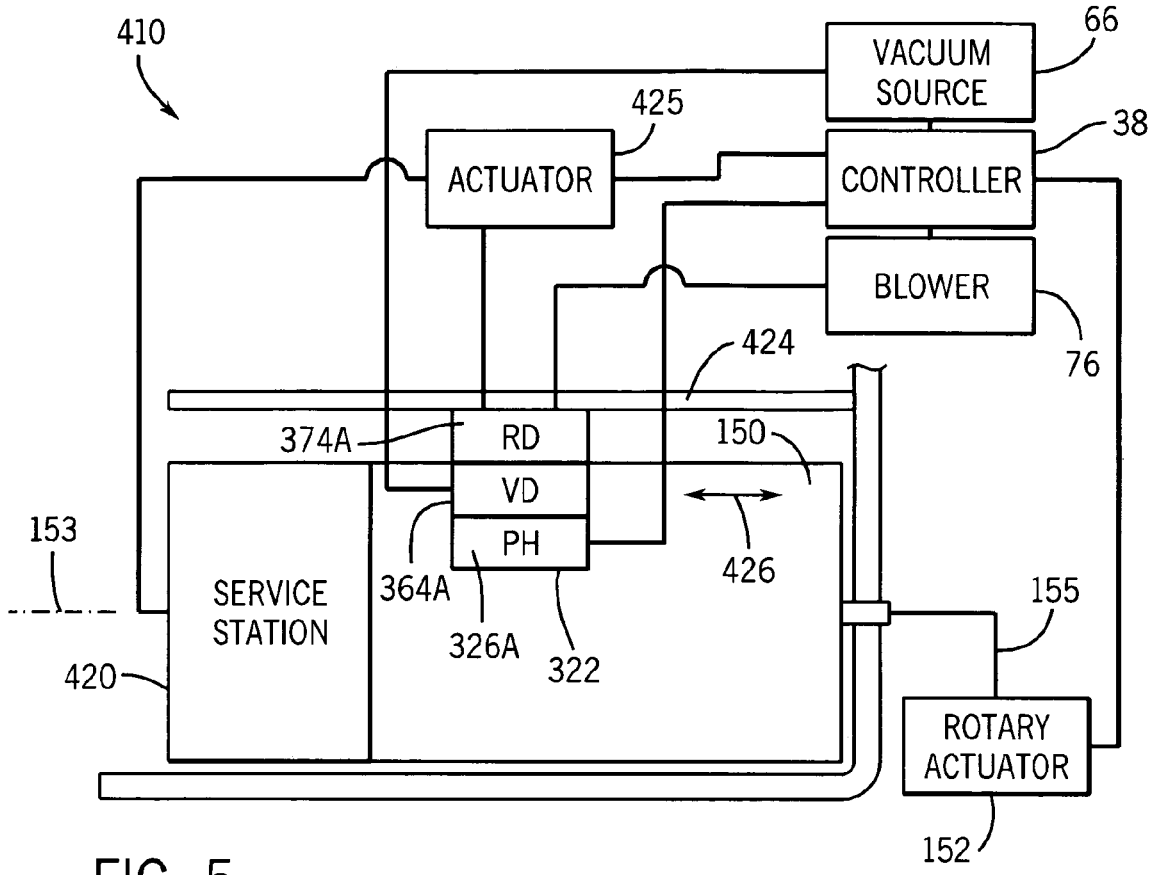
FIG. 5 is a schematic illustration of a particular embodiment of the printing system of FIG. 4 according to one example embodiment.

FIG. 5 schematically illustrates printing system 410, another embodiment of system 10 shown in FIG. 1. Printing system 410 is one particular embodiment of printing system 310 shown in FIG. 4. In printing system 410, support 322 is configured to be moved parallel to axis 153. As shown by FIG. 5, printing system 410 additionally includes service station 420, guide 424 and actuator 425. Service station 420 comprises an arrangement of one or more mechanisms configured to service printheads 326. In the embodiment shown, service station 420 is located on an axial end of drum 150 that includes components arranged in an arc having substantially the same arc as drum 150. In one embodiment, service station 420 is configured to perform operations such as spitting, wiping and capping of nozzles of printheads 326. Service station 420 performs such operations generally in response to control signals from controller 38. In other embodiments, service station 420 may be omitted, may be configured to perform fewer or greater of such servicing operations or may be supported at other locations with respect to drum 150.

Guide 424 comprises one or more structures configured to movably support and suspend support 322 (serving as a carriage) with respect to drum 150 and service station 420. In one embodiment, guide 424 may comprise an elongate rail extending substantially parallel to axis 153 along drum 150 and service station 420. In other embodiments, guide 424 may have other configurations such as rods, beams, bars and the like.

Actuator 425 comprises a mechanism configured to move support 322 along guide 424 in directions indicated by arrows 426. In the particular example shown, actuator 425 is configured to move support 322 and the printheads 326, vacuum ducts 364 and replenishment ducts 374 between one or more printing positions generally opposite to drum 150 and one or more servicing positions generally opposite to service station 420. In one embodiment, actuator 425 comprises a toothed pulley operably driven by a rotary and in engagement with a toothed belt coupled to support 322. In other embodiments, one or more hydraulic or pneumatic cylinder-piston assemblies configured to move support 322 along guide 424 may be used. In another embodiment, other linear actuators may be utilized such as electric solenoids, a motor driving a pinion in engagement with a movable rack coupled to support 322, a motor rotatably driving a pinion coupled to support 322 and in engagement with a rack along guide 424, or other linear actuator arrangements.

Figure 6:
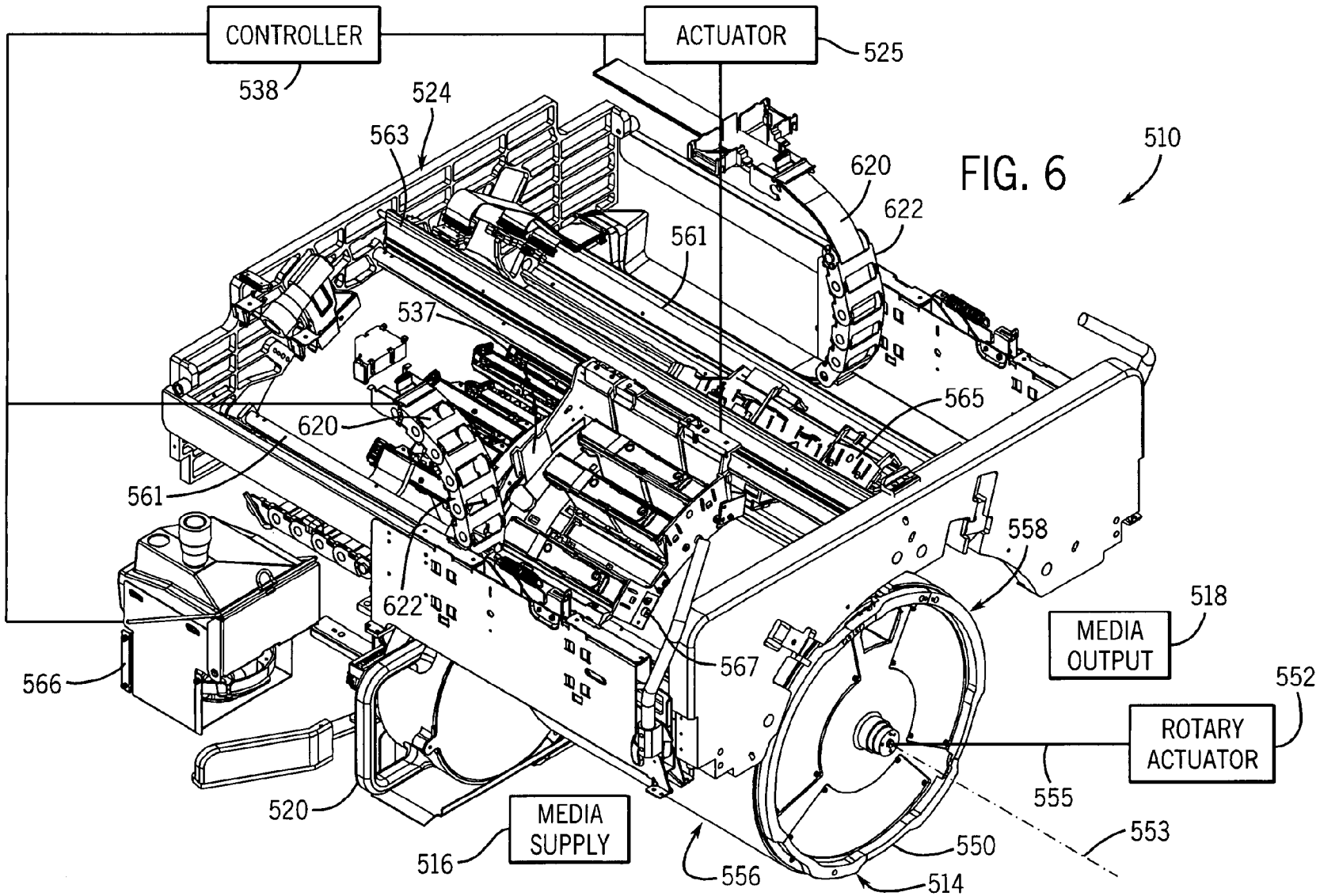
FIG. 6 is a top perspective view of another embodiment of the printing system of FIG. 1 according to one example embodiment.

FIG. 6 is a top perspective view illustrating printing system 510, another embodiment of printing system 10 shown in FIG. 1. Printing system 510 generally includes media transport 514, a media supply 516 and media output 518 (shown and described with respect to FIG. 4), imaging unit 537, guide 524, actuator 525 and controller 538. Media transport 514 is configured to move a medium, such as a sheet of paper or other media, in an arc relative to imaging unit 537. Media transport 514 includes drum 550 and rotary actuator 552. Drum 550 generally comprises an elongate cylinder configured to be rotatably driven about axis 553 by rotary actuator 552 such that drum 550 has an upstream side 556 with respect to imaging unit 537 and a downstream side 558 with respect to imaging unit 537. Rotary actuator 552 comprises a source of torque, such as a motor, operably coupled to drum 550 and transmission 555 (schematically shown) by a series of gears, a chain and sprocket arrangement, belt and pulley arrangement and the like.

Media supply 516 and media output 518 (schematically shown) are substantially similar to media supply 216 and media output 218 described above with respect to printing system 310. Media supply 516 supplies media to drum 550. In the particular embodiment shown, media supply comprises a mechanism configured to pick an individual sheet of media from a stack of media and to supply individual sheets to drum 550 such that the sheet is wrapped at least partially about drum 550. Media output 518 comprises a mechanism configured to withdraw printhead media from drum 550 and to transport the withdrawn media to and contain withdrawn media within an output tray, bin and the like.

Guide 524 comprises structures configured to movably support and suspend imaging unit 537 with respect to drum 550 and service station 520. In particular example shown, guide 524 comprises a framework partially surrounding drum 550 and service station 520. Guide 524 includes outer guide rails 561 and intermediate rail 563. Rails 561 and 563 extend along axis 553 to movably support imaging unit 537. In the particular example shown, rails 561 and 563 are configured to allow imaging unit 537 to slide along axis 553 from a printing position opposite drum 550 and a servicing position opposite service station 520. In other embodiments, other structures or mechanisms may be utilized to movably support imaging unit 537 for movement along axis 553.

Service station 520 comprises an arrangement of one or more mechanisms configured to service imaging unit 537. Service station 520 is located on an axial end of drum 550 and includes servicing components arranged in an arc having substantially the same arc as drum 550. In the particular example shown, service station 520 is configured to perform an operation such as spitting, wiping and capping of nozzles of imaging unit 537. Service station 520 performs such operations generally in response to control signals from controller 538. A detailed description of service station 520 may be found in co-pending U.S. patent application Ser. No. 11/081,161 filed on Mar. 16, 2005 by John A. Barinaga, Tanya V. Burmeister, Stephanie L. Seaman, Alan Shibata, Russell P. Yearout and Antonio Gomez entitled "WEB," the full disclosure of which is hereby incorporated by reference. In other embodiments, service station 520 may have other configurations, or may be configured to perform fewer or greater of such servicing operations, may be supported at other locations with respect to drum 550 or may be omitted.

Actuator 525 comprises a mechanism configured to move imaging unit 537 along paths 561 and 563 of guide 524 and axis 553. According to one example embodiment, actuator 525 (schematically shown) comprises a toothed pulley or gear operably driven by a motor and in engagement with toothed belt (not shown) operably coupled to imaging unit 537. In other embodiments, other rotary actuators may be used to move imaging unit 537 along axis 553 with respect to drum 550 and with respect to service station 520.

Imaging unit 537 comprises a structure generally configured to dispense fluid or imaging material and printing material, such as ink fixing agents, upon a medium held by drum 550 while removing resultant aerosol that may be formed during the dispensing of the fluid or imaging material. In the particular example shown, imaging unit 537 is further configured to replenish at least a portion of air that is removed during the removal of aerosol. As shown by FIG. 6, imaging unit 537 is slidably supported by rails 561 and 563 and is configured to be moved by actuator 525 from a printing position in which imaging unit 537 is positioned opposite to drum 550 from a servicing position in which imaging unit 537 is positioned opposite to service station 520.

Figure 7:
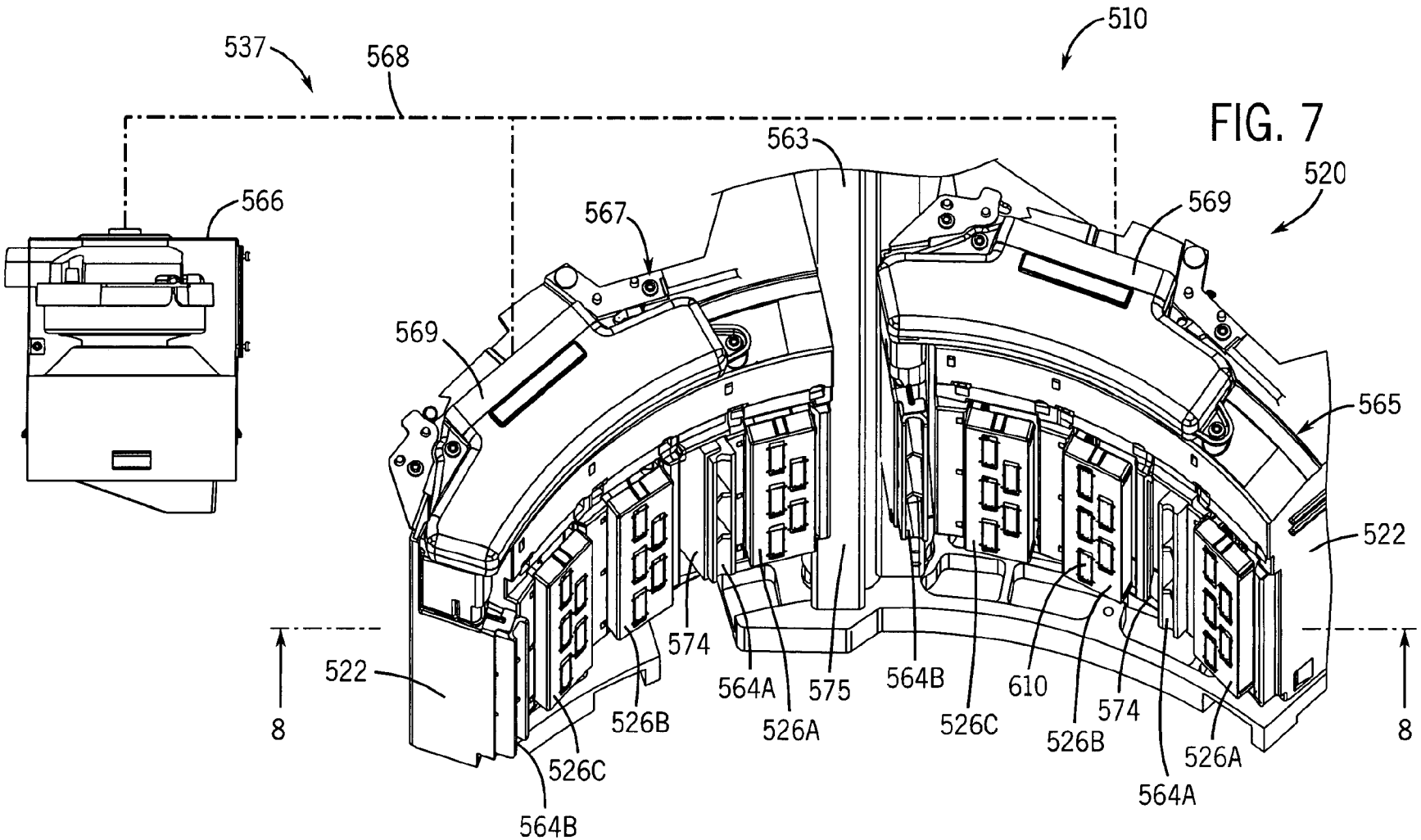
FIG. 7 is a bottom perspective view of an imaging unit of the printing system of FIG. 6 according to one example embodiment.
Figure 8:
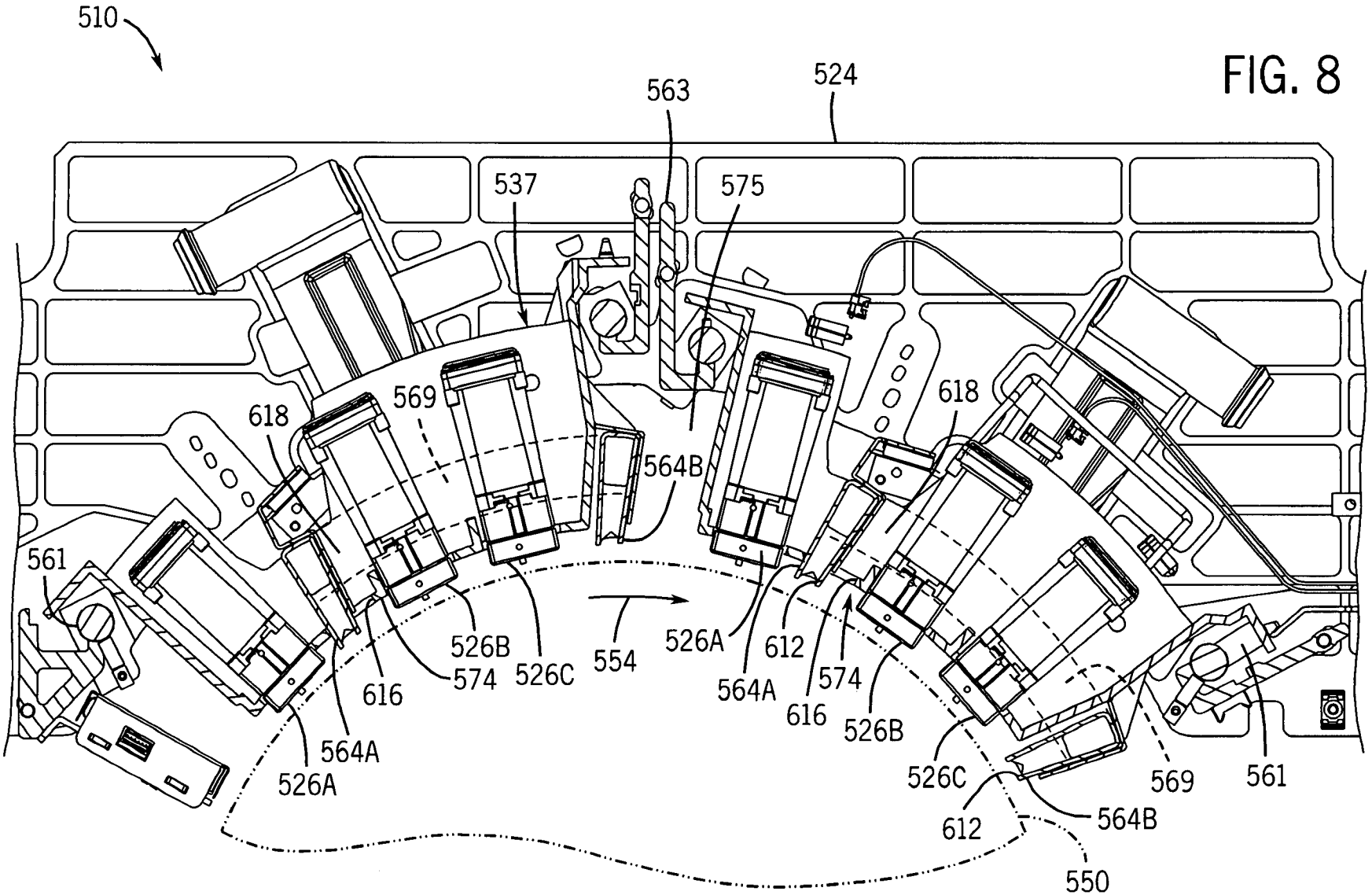
FIG. 8 is a sectional view of the printing system of FIG. 7 taken along line 8-8 according to one example embodiment.

FIGS. 7 and 8 illustrate an example embodiment of imaging unit 537. As shown by FIG. 7, imaging unit 537 generally includes imaging segments 565, 567 and vacuum source 566. Imaging segments 565 and 567 are substantially identical to one another and are each movably supported along rails 561, 563 (shown in FIG. 6). Each of segments 565, 567 includes support 522, printheads 526A, 526B, 526C (collectively referred to as printheads 526), vacuum ducts 564A, 564B and replenishment duct 574. Support 522 generally comprises framework of one or more structures configured to support printheads 526A, 526B and 526C, vacuum ducts 564A, 564B in an arc with respect to drum 550 (shown in FIG. 8). Supports 522 further form vacuum duct 574. In the particular example illustrated, supports 522 of segments 565 and 567 are circumferentially spaced from one another at their attachments to rail 563 so as to form an additional replenishment duct 575.

Printheads 526A, 526B and 526C comprise thermal inkjet printheads including multiple nozzle plates 610 through which imaging material is dispensed. Each of printheads 526 is supported in relative close proximity to the surface of drum 550 (shown in FIG. 8). According to one example embodiment, nozzle plates 610 of printheads 526 are supported by support 522 at a spacing of between about 1 and 2 millimeters and nominally about 1.3 millimeters with respect to the surface of drum 550. In other embodiments, the spacing between printheads 526 and drum 550 may be non-uniform or may have other spacings from drum 550.

In the particular example shown, printhead 526A is located at an upstream side 556 of its respective segment 565, 567 and is configured to dispense an ink fixer material. Printhead 526B is supported by support 522 between printheads 526A and 526C. Printhead 526B is supported between replenishment duct 574 and printhead 526C. In the embodiment shown, printhead 526B is configured to dispense imaging material such as black ink and yellow ink. Printhead 526C is supported by support 522 at a downstream side of segment 565 between printhead 526B and vacuum duct 564B. In the embodiment shown, printhead 526C is configured to dispense imaging material such as cyan ink and magenta ink. In other embodiments, printheads 526A, 526B and 526C may alternatively be configured to dispense other imaging materials.

Vacuum ducts 564A and 564B comprise ducts, plenums, portals, tubes, channels or other structures forming a passage through which vacuum supplied by vacuum source 566 may be applied to remove aerosol resulting from the dispensing of imaging material by printheads 526A, 526B and 526C. As shown by FIG. 8, ducts 564A and 564B have outlet openings 612 that are tangent to drum 550 while being angled in an upstream direction with respect to the direction in which drum 550 is rotating and carrying media as indicated by arrow 554. In one embodiment, outlet openings 612 are oriented at an angle up to 45 degrees relative to the surface of the drum 550 depending upon space constraints. Because outlet openings 612 are not oriented perpendicular to the surface of drum 550, outlet openings 612 apply a vacuum to those volumes beneath printheads 526A, 526B and 526C to remove resulting aerosol.

In the example shown, outlet openings 612 are positioned in relative close proximity to downstream printheads 526A, 526B and 526C. According to one embodiment, the circumferential spacing between a downstream edge of outlet opening 612 and the closest row of nozzles in the next successive printhead 526 is less than or equal to about 40 millimeters, at least about 15 millimeters and nominally about 16.75 millimeters. In other embodiments, the spacing between outlet openings 612 of vacuum ducts 564 and downstream printheads may vary.

Vacuum source 566 supplies a vacuum to each of ducts 564. In the example embodiment, vacuum source 566 comprises a blower. As shown by FIG. 7, vacuum source 566 is pneumatically connected to vacuum ducts 564 by conduit 568 (schematically shown) and plenums 569. Conduits 568 generally comprise elongate flexible hoses or tubes extending between vacuum source 566 and plenums 569. Plenums 569 are coupled to each of supports 522 of segments 565, 567. Each plenum 569 is pneumatically connected to both of vacuum ducts 564A, 564B. In other embodiments, vacuum source 566 may comprise other devices and may be pneumatically connected to vacuum ducts 564A and 564B in other manners.

Replenishment duct 574 extends through support 522 and is configured to allow air removed by vacuum ducts 564A, 564B to be at least partially replenished. As shown by FIG. 8, replenishment duct 574 includes an outlet opening 616 and an outwardly extending passage 618 through which air may be supplied to drum 550. In the particular example shown, passage 618 is formed by a gap between printhead 526B and vacuum duct 564A. In other embodiments, replenishment ducts 574 may be formed by structures dedicated to defining duct 574 such as tubes, hoses, channels and the like. In still other embodiments, replenishment duct 574 may be provided with a supply of air such as a blower.

In the embodiment shown, outlet opening 616 of replenishment duct 574 is configured so as to be as large as possible to supply a sufficient volume of air at a relatively low velocity while maintaining the compactness of segments 565, 567 and of imaging unit 537. In the particular example shown, outlet opening 616 of replenishment duct 574 is spaced from vacuum duct 564A by the thickness of walls separating these components, nominally about 4 millimeters. The upstream edge of outlet opening 616 of replenishment duct 574 is circumferentially spaced from the closest nozzle of printhead 564B by as large as possible. In the example shown, the upstream edge of outlet opening 616 is spaced from the closest nozzle of printheads 564B by about 12 millimeters. In other embodiments, outlet opening 616 may have other spacings with respect to adjacent printheads of vacuum ducts.

Openings 616 of induction ducts 574 are spaced from drum 550 at substantially the same spacing from drum 550 as printheads 526. In the particular embodiment illustrated, for reasons related to manufacturing tolerances, outlet opening 616 are elevated above nozzle plate 610 of printheads 526 by about 0.7 millimeters. In other embodiments, outlet opening 616 may be spaced from drum 550 by other distances.

Controller 538 (shown in FIG. 6) comprises a processing unit in communication with actuator 525, printheads 526 and vacuum source 566. As shown by FIG. 6, in the example embodiment shown, controller 538 communicates with printheads 526 of segments 565, 567 via flexible circuits or wiring 620 carried by articulating tracks 622 which facilitate communication with imaging unit 537 as imaging unit 537 is moved by actuator 525 along axis 553.

In operation, controller 538 generates control signals based upon input image data directing the operation of printheads 526. Controller 538 further generates control signals directing the operation of media supply 516, media output 518 and rotary actuator 552. Based upon the speed at which rotary actuator 552 rotatably drives drum 550, the characteristics of the imaging data and the dispensation of imaging material upon a medium, controller 538 generates control signals showing the rate at which vacuum is applied by vacuum ducts 564 to remove aerosol. In other embodiments, controller 538 may control vacuum source 566 such as a steady vacuum is applied or may vary the vacuum supplied by vacuum source 566 by a fewer or greater number of such factors.

According to one example embodiment, rotary actuator 552 rotatably drives drum 550 such that the surface of drum 550 rotates at a speed of about 30 inches per second. During printing, controller 538 generates control signals directing vacuum source 566 to supply a vacuum to vacuum ducts 564 such that air is drawn through vacuum ducts 564 at a velocity of between about 200 and 250 feet per minute to sufficiently withdraw aerosol. The proximity of printheads 564 to drum 550 and the high rate at which drum 550 is driven may further result in air being removed from between drum 550 and printheads 564. In the particular embodiment shown, replenishment ducts 574 of segments 565, 567, as well as replenishment duct 575 are configured so as to sufficiently replenish such removed air to reduce the likelihood of air being drawn from the axial ends of drum 550 which may otherwise create crossflow and may undesirably deflect droplets of imaging material being dispensed by printheads 564. In one embodiment, each of replenishment ducts 574, 575 is configured to supply air at a rate of about 7 cubic feet per minute to replenish air withdrawn by vacuum ducts 564 and an additional 3 to 7 cubic feet per minute to replenish air removed resulting from rotation of drum 550. In other embodiments, vacuum duct 574 may be configured to replenish air at other rates depending upon the rate at which drum 550 is rotated, the proximity of printheads 526 with respect to drum 550 and the rate at which air is withdrawn by vacuum ducts 564.

Overall, printing systems 10, 110, 210, 310, 410 and 510 are configured to attain relatively high printing speeds while maintaining print quality. In particular, printing systems 10, 110, 210, 310, 410 and 510 enable their printheads to be supported in relatively close proximity to the media support for print quality. At the same time, aerosol is removed such that the deposition of aerosol upon the media being printed upon is reduced to enhance print quality. Printing systems 10, 110, 310, 410 and 510 replenish removed air resulting from the removal of aerosol and resulting from the relative high speed at which media is moved to minimize or prevent transverse flow of air which may deflect imaging material prior to reaching the media. Systems 210, 310, 410 and 510 further enhance the printing speed by arcuately supporting the printheads about a rotatably driven drum carrying media to be printed upon. Printing systems 410 and 510 additionally move printheads along the axis of the drum for servicing of such printheads and for increasing the cost and size of such printing systems.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A printing system comprising:

a first printhead;

a first induction duct; and a first vacuum duct between the printhead and the induction duct; and a second printhead, wherein the first induction duct and the first vacuum duct are between the first printhead and the second printhead.

2. The printing system of claim 1, wherein the first printhead and the second printhead are arranged in an arc.

3. The printing system of claim 2, wherein the first printhead and the second printhead are supported by a carriage.

4. The printing system of claim 1, wherein the first printhead and the second printhead are supported by a carriage.

5. The printing system of claim 1 further comprising a media transport configured to move a medium relative to the first printhead.

6. The printing system of claim 5, wherein the media transport is configured to move the medium at a velocity of at least 30 inches per second relative to the first printhead.

7. The printing system of claim 5, wherein the first printhead is upstream relative to the first induction duct.

8. The printing system of claim 5, wherein the media transport comprises a drum.

9. The printing system of claim 1 further comprising a second vacuum duct on an opposite side of the first printhead as the first vacuum duct.

10. The printing system of claim 1 further comprising an air handling device configured to advance air through the first induction duct.

11. The printing system of claim 10, wherein the air handling device comprises a blower.

12. The printing system of claim 1 further comprising a carriage configured to be moved relative to media, the carriage supporting the first printhead, the first induction duct and the first vacuum duct.

13. The printing system of claim 12, wherein the first printhead, the first induction duct and the first vacuum duct are arranged in an arc.

14. The printing system of claim 1 further comprising:

a vacuum source configured to apply a vacuum through the first vacuum duct; and an air handling device configured to advance air through the first induction duct concurrent with the vacuum applied by the vacuum source.

15. The printing system of claim 14, wherein the air handling device comprises a blower.

16. The printing system of claim 14, wherein the air handling device has an input side facing an exterior of the printing system and output side facing the first induction duct.

17. A printing system comprising:

a carriage;

a first printhead and a second printhead arranged in an arc and carried by the carriage;

a first vacuum duct between the first printhead and the second printhead and carried by the carriage; and a first induction duct between the first vacuum duct and the second printhead and carried by the carriage.

18. The printing system of claim 17 further comprising a media transport configured to move a medium relative to the first printhead and the second printhead, wherein the first induction duct is downstream the first vacuum duct.

19. The printing system of claim 18, wherein the media transport comprises a drum about which medium may be wrapped.

20. The printing system of claim 17 further comprising an air handling device configured to advance air through the first induction duct.

21. The printing system of claim 17 further comprising a second vacuum duct carried by the carriage on an opposite side of the first printhead and the first vacuum duct.

22. The printing system of claim 21 further comprising a third vacuum duct carried by the carriage on an opposite side of the second printhead as the first vacuum duct.

23. A printing system comprising:

a carriage;

a first printhead and a second printhead arranged in an arc that is supported by the carriage;

means carried by the carriage for withdrawing air carrying aerosol from proximate the printhead; and means carried by the carriage for replacing at least a portion of withdrawn air.

24. A method comprising:

moving a carriage carrying an arcuate arrangement of a first printhead and a second printhead;

withdrawing air carrying aerosol from proximate the first printhead through the carriage; and replacing at least a portion of withdrawn air by passing air through the carriage to proximate the first printhead.

25. The method of claim 24 further comprising moving a medium about an axis relative to the arcuate arrangement of the first printhead and the second printhead.

26. The method of claim 25, wherein the medium is moved at a velocity of at least 30 inches per second.

27. The method of claim 24, wherein the air is withdrawn through a duct carried by the carriage and wherein the air is replaced through a duct carried by the carriage.

28. A printing system comprising:

a first printhead;

a first induction duct;

a first vacuum duct between the printhead and the induction duct; and a media transport configured to move a medium relative to the first printhead, wherein the first printhead is upstream relative to the first induction duct.

29. A printing system comprising:

a first printhead;

a first induction duct;

a first vacuum duct between the printhead and the induction duct; and a second vacuum duct on an opposite side of the first printhead as the first vacuum duct.

30. A printing system comprising:

a first printhead;

a first induction duct;

a first vacuum duct between the printhead and the induction duct; and a carriage configured to be moved relative to media, the carriage supporting the first printhead, the first induction duct and the first vacuum duct.

* * * * *